United States Patent [19]

Wolff et al.

[11] 4,275,691

[45] Jun. 30, 1981

[54] ELECTROMECHANICAL PRECISION GOVERNOR FOR INTERNAL COMBUSTION ENGINES

[76] Inventors: George D. Wolff; Michael S. Ziemacki, both of P.O. Drawer 9407, Winter Haven, Fla. 33880

[21] Appl. No.: 9,260

[22] Filed: Feb. 5, 1979

[51] Int. Cl.[3] ..... F02B 3/00; F02B 33/00

[52] U.S. Cl. ..... 123/352; 123/351; 123/385; 91/363 R

[58] Field of Search .... 123/140 FG, 139 E, 140 MC, 123/102, 32 EA, 379, 385, 351, 352; 91/361, 363 A, 363 R

[56] References Cited

U.S. PATENT DOCUMENTS

| | | | |
|---|---|---|---|
| 2,879,467 | 3/1959 | Stern | 123/140 FG |
| 3,452,645 | 7/1969 | Barltrop | 91/363 A |
| 3,659,571 | 5/1972 | Lang | 123/32 EA |
| 3,716,035 | 2/1973 | Adler | 123/32 EA |
| 3,724,430 | 4/1973 | Adler | 123/32 EA |
| 3,973,537 | 8/1976 | Williams | 123/140 MC |
| 3,978,837 | 9/1976 | Lundberg | 123/139 E |
| 4,019,478 | 4/1977 | Hobo | 123/139 E |
| 4,164,167 | 8/1979 | Imai | 91/363 R |
| 4,174,694 | 11/1979 | Wessel | 123/32 EA |

*Primary Examiner*—Charles J. Myhre
*Assistant Examiner*—Carl Stuart Miller
*Attorney, Agent, or Firm*—Duckworth, Hobby, Allen, Dyer & Pettis

[57] ABSTRACT

An electronically controlled, hydraulically actuated precision governor controls the operating RPM of an internal combustion engine by repositioning the engine throttle in response to changes in engine RPM. The piston of a hydraulic actuator is coupled to the throttle. The flow of hydraulic fluid to the actuator is controlled by a specially designed hydraulic valve which includes a piston the displacement of which is regulated by controlling the pressure in a pressurized control chamber. The fluid pressure in the pressurized control chamber is regulated by a pair of electronically controlled fuel injector nozzles. The electronic circuitry which controls the two electronic fuel injector nozzles receives electronic inputs corresponding to the operating RPM of the engine, the desired engine operating RPM and engine throttle position.

29 Claims, 3 Drawing Figures

ELECTROMECHANICAL PRECISION GOVERNOR FOR INTERNAL COMBUSTION ENGINES

BACKGROUND OF THE INVENTION

1. Field of the Invention

This invention relates to governors, and more particularly, to electronically controlled, hydraulically actuated precision governors for controlling the operating RPM of an internal combustion engine.

2. Description of the Prior Art

The prior art disclose numerous governing devices for regulating the operating RPM of internal combustion engines.

In U.S. Pat. Nos. 3,395,718, 3,530,672 and 3,574,475, (Wolff) discloses various diesel engine governor structures which include hydraulically displaceable actuators coupled to the rack of the diesel engine fuel injection pump for controllably displacing the rack to regulate the operating RPM of the engine.

U.S. Pat. No. 3,777,174 (Butscher) discloses an electronic speed regulator for internal combustion engines and incorporates an electronic control means including proportional, integral and derivative amplifiers. U.S. Pat. No. 3,978,837 (Lundberg) discloses an automatic speed control device for diesel engines including a hydraulic actuator for positioning the diesel engine throttle and a means for producing a position signal corresponding to throttle position. U.S. Pat. No. 3,648,798 (Jania) discloses a speed control system for an automotive vehicle including electronic control means having a throttle position transducer for controlling the engine throttle position.

U.S. Pat. No. 3,556,154 (Kramer) discloses an electro-hydraulic control arrangement for which a double acting spool valve has electrical controls actuated by electomagnetic on-off valves.

U.S. Pat. No. 4,006,791 (Feldman) discloses an electrical circuit for regulating the operating RPM of an engine and incorporated pneumatic pressure for driving an actuator to reposition the engine throttle.

U.S. Pat. Nos. 3,372,680 and 3,587,540 disclose electrically actuated solenoid type fuel injectors for regulating the flow of a pressurized hydraulic fluid.

The following U.S. patents are also of interest: U.S. Pat. Nos. 3,699,935 (Adler); 3,842,815 (Bechstein); 3,832,846 (Leeson); 3,830,211 (Bechstein); 3,800,755 (Klaiber); 3,893,537 (Sakakibara); 3,884,205 (Staudt); 3,884,206 (Ritter); 3,847,127 (Staudt); 3,841,111 (Staudt); 3,897,763 (Williams); 3,425,401 (Lang); 3,426,777 (Plummer); 3,225,814 (Capwell), 3,651,793 (Reth); 3,556,668 (Marsukh); 3,741,176 (Schmidt); 3,570,460 (Rabus); 3,766,367 (Sumiyoshi); 3,752,252 (Sakakibara); 3,485,316 (Slavin); 3,447,624 (Balan); 3,340,950 (Hopengarten); 3,332,406 (Perry); 3,249,175 (Baxter); 3,195,672 (Brennan); 3,087,340 (McMurray); 3,070,185 (Fales); 3,438,361 (Wagner); 3,442,277 (Barnes); 3,370,218 (Merz); 3,251,373 (Drake); 3,614,946 (Staudt); 3,898,962 (Honig); 3,630,177 (Engel); 3,659,571 (Lang); 3,112,406 (Avery).

SUMMARY OF THE INVENTION

The present invention contemplates an electronically controlled, hydraulically actuated precision governor for controlling the operating RPM of a diesel engine by repositioning the rack of the engine fuel injection pump in response to changes in engine RPM. The governor can also be used to control the operating RPM of any internal combustion or other engine. The governor includes a main chamber having first and second end surfaces and a piston slideably positionable about a neutral location within said main chamber and having first and second faces. Biasing means is located between the first end surface of the main chamber and the first face of the piston for biasing the piston toward the second end surface of the main chamber. An unpressurized chamber is positioned within the main chamber between the first end surface thereof and the first face of the piston. A variable pressure control chamber is positioned within the main chamber between the second end surface thereof and the second face of the piston. First electrically controllable valve means is coupled to the control chamber and to a source of pressurized fluid for regulating the pressure in the control chamber in response to a control signal to controllably displace the piston in the main chamber. An inlet port is positioned in the main chamber between the first and second faces of the piston and coupled to the source of pressurized fluid. Actuator means is hydraulically coupled to the main chamber at a point between the first and second faces of the piston for displacing the rack of the fuel injection pump in response to fluid pressure from the main chamber. Second valve means is coupled to the main chamber and to the actuator means for conducting pressurized fluid from the inlet port to the actuator means to displace the actuator means in a first direction when the piston is displaced toward the first end surface of the main chamber. The second valve means also displaces the actuator means in a second direction when the piston is displaced toward the second end surface of the main chamber. Control means are coupled to the rack of the fuel injection pump and to the first valve means. The control means indludes RPM sensor means for measuring the operating RPM of the engine and RPM command means for designating a selected engine operating RPM. The control means generates the control signals which actuate the first valve means to displace the piston to reposition the rack of the fuel injection pump to maintain the selected RPM of the engine.

Without significant structural modifications, the present invention can also be used to precisely control the position of something other than the rack of a diesel engine fuel injection pump or the throttle of other types of internal combustion engines. In this latter configuration, actuator position feedback means are provided for generating an electrical signal representative of the position of the actuator piston. A position input signal is provided to the control means in order to control the movement of the actuator piston which is directly coupled to the device being precisely positioned by the present invention.

DESCRIPTION OF THE DRAWING

The invention is pointed out with particularity in the appended claims, however, other objects and advantages together with the operation of the invention, may be better understood by reference to the following detailed description taken in connection with the following illustrations wherein:

DESCRIPTION OF THE PREFERRED EMBODIMENT

In other to better illustrate the advantages of the invention and its contributions to the art, a preferred hardware embodiment of the invention will now be described in some detail.

Figure 1:
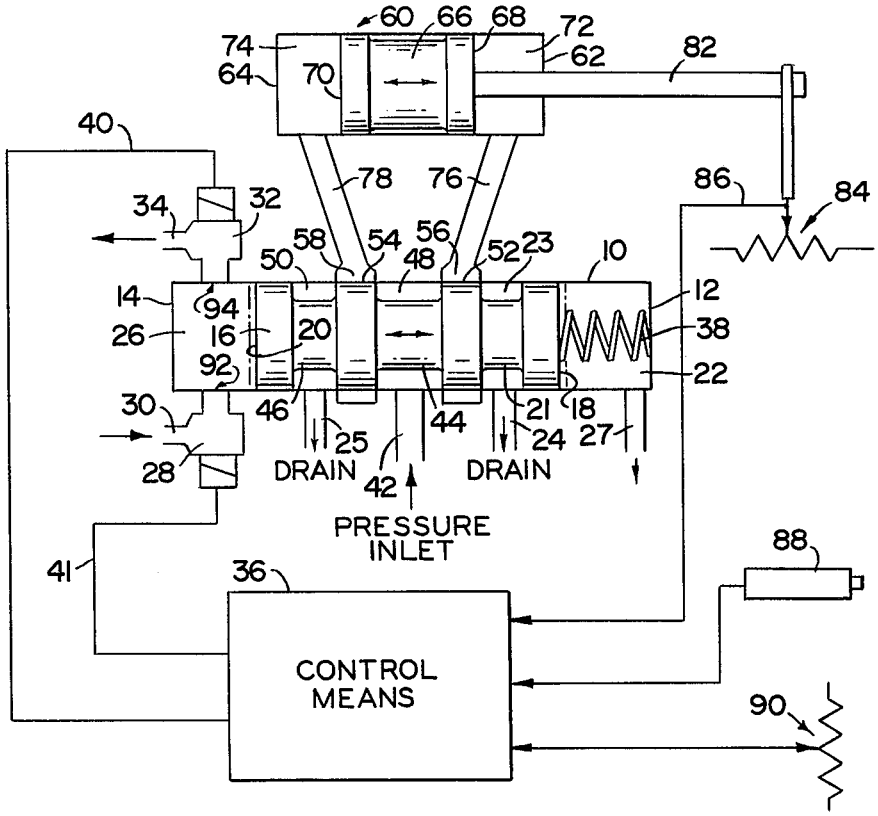
FIG. 1 is a partial sectional and partial block diagram representation of the governor of the present invention.

Referring now to FIG. 1, the primary mechanical element of the governor of the present invention includes a main chamber 10 having a first end surface 12 and a second end surface 14. A piston 16 is slideably positionable within main chamber 10 and includes first face 18 and second face 20. In FIG. 1, piston 16 is illustrated in its neutral position.

An unpressurized chamber 22 is located between the second face of piston 16 and the first end surface 12 of main chamber 10. A drain port 27 is connected with unpressurized chamber 22 to discharge fluid therefrom. Drain port 27 is normally connected to the fuel tank of a diesel engine so that the diesel engine fuel which normally serves as hydraulic fluid for the sytem is not wasted upon discharge from unpressurized chamber 22.

A variable pressure control chamber 26 is positioned between the second face of piston 16 and the second end surface of main chamber 10.

Pressure increasing valve means in the form of an electronic fuel injector nozzle 28 is coupled to a source of pressurized hydraulic fluid by line 30. Line 30 is typically connected to a source of pressurized diesel fuel having a pressure of approximately 40 PSI. Pressure reducing valve means in the form of an electroncially controlled fuel injector nozzle 32 is coupled to control chamber 26 and to drain line 34 for reducing the pressure in the control chamber in response to a control signal from electronic control means 36. Fuel injectors 28 and 32 are referred to collectively as the first electrically controllable valve means and together function to regulate the pressure in the control chamber in response to electrical control signals from control means 36 to controllably displace piston 16 within main chamber 10. In the preferred embodiment, fuel injectors 28 and 32 are manufactured by the Robert Bosch Corporation and are designated by part No. 0280150036.

Biasing means or a spring 38 is positioned between the first end surface 12 of main chamber 10 and the first face of piston 16 in order to counteract the forces generated by the pressurized fluid within variable pressure control chamber 26.

Electrical leads of the type indicated by reference numbers 40 and 41 extend from fuel injectors 28 and 32 and are coupled to control means 36. A source of 40 PSI diesel fuel is coupled to inlet port 42 of main chamber 10.

The outer wall of piston 16 includes first, second and third cylindrical indentations 44, 46 and 21 which form a cylindrical first sliding chamber 48, a cylindrical second sliding chamber 50 and a cylindrical third sliding chamber 23 between the first, second and third indentations in the wall of the main chamber.

A first valve surface 52 is formed on the outer wall of piston 16 between third sliding chamber 23 and first sliding chamber 48. A second valve surface 54 is formed on the outer wall of piston 16 between the first sliding chamber 48 and the second sliding chamber 50.

A cylindrical first port 56 is formed in the wall of main chamber 10 adjacent first valve surface 52. A cylindrical second port 58 is formed in the wall of the main chamber 10 adjacent the second valve surface 54. Ports 56 and 58 form seal with valve surfaces 52 and 54 so that fluid flow is prevented while piston 16 is in its neutral position as shown in FIG. 1.

Hydraulic actuator means 60 includes a cylinder having a first end 62 and a second end 64. Actuator means 60 further includes a piston 66 having a first face 68 and a second face 70. A first chamber 72 is formed between the first face of the piston 66 and first end 62. A second chamber is formed between the second face of cylinder 66 and second end 64. A first passageway 76 establishes fluid communication between the first port 56 and the first chamber 72, while a second passageway 78 establishes fluid communication between the second port 58 and the second chamber 74.

Second valve means includes elements 21, 44, 46, 23, 48, 50, 52, 54, 56 58, 76, 78, 24 and 25. Each of these elements of the second valve means serves to conduct pressurized fluid from inlet port 42 to actuator means 60 to displace actuator means 60 in a first direction when piston 16 is displaced toward first end surface 12 of main chamber 10 and to displace actuator means 60 in a second direction when piston 16 is displaced toward second end surface 14 of main chamber 10.

An arm 82 is coupled to piston 66 of actuator means 60 and to the rack of the fuel injection pump (not shown) of the diesel engine. The wiper of a potentiometer 84 is mechanically coupled to arm 82 in order to effect changes in electrical resistance which are directly proportional to the mechanical displacement of arm 82. An electrical conductor 86 connects the wiper arm of potentiometer 84 to an input of control means 36. Potentiometer 84 serves as a rack position feedback means to produce an electrical signal which corresponds to the mechanical position of arm 82.

RPM sensor means or magnetic pickup 88 is attached in close proximity to the diesel engine flywheel or some other rotary element of the diesel engine in order to generate an electrical signal representative of the operating RPM of the engine. RPM command means or speed adjustment potentiometer 90 produces an electrical signal representative of the selected engine operating RPM which is coupled to an input of control means 36. In typcial pumping or electrical generating applications, speed adjustment potentiometer 90 is typically set to produce a fixed operating RPM for the diesel engine even though the load on the engine may vary by a substantial degree. Element 90 might also be used as a throttle in a transportation application such as in controlling the RPM of the diesel engine in a truck.

In the preferred embodiment, 40 PSI diesel fuel is used as the hydraulic medium and variable pressure control chamber 26 is generally maintained at a pressure of approximately 20 PSI when the piston is in its equilibrium or neutral position. Spring 38 exerts a spring force of approximately twenty pounds between first face 18 and first end surface 12. Thus, whenever port 92 of fuel injector nozzle 28 is open, additional fluid will flow into control chamber 26, increasing the pressure therein and causing piston 16 to be displaced to the right against the force exerted by spring 38. Conversely, whenever port 94 of fuel injector 32 is opened, fluid will be discharged from control chamber 26 causing the pressure therein to decrease and piston 16 to be displaced to the left by the excess force exerted by spring 38. Injectors 28 and 32 are never actuated simulatneously.

The operation of the governor of the present invention will now be discussed by referring to FIG. 1. Speed adjustment potentioneter 90 is adjusted to designate a specified engine operating RPM. Magnetic pickup 88 generates an electrical signal representative of the actual operating RPM of the engine. Control means 36 measures the difference between the selected operating RPM and the actual operating RPM and generates a control signal in order to zero out the RPM difference between the selected and actual operating RPM.

In FIG. 1, it is assumed that a rightward movement of arm 82 will actuate the fuel injection pump of the engine to decrease the fuel flow to the engine and thereby decrease the operating RPM of the engine. If control means 36 senses that the engine RPM is above the desired operating RPM, it will generate an electrical control signal which will cause fuel injector 32 to be actuated, opening port 94 and permitting a predetermined amount of fluid to be discharged from control chamber 26. As a result of the force exerted by spring 38 on piston 16, piston 16 will be displaced very slightly to the left of its neutral or equilibrium position. This leftward displacement of piston 16 will cause second valve surface 54 to also slide leftward, opening a narrow aperture between the first sliding chamber 48 and port 78. Hydraulic fluid from inlet port 42 will pass through first sliding chamber 48 and second passageway 78 into second chamber 74, increasing the pressure therein. First valve surface 52 will also be displaced to the left, opening a small aperture between first port 56 and third sliding chamber 23. This will permit an outward flow of hydraulic fluid from first chamber 72 through first passageway 76 into sliding chamber 23 and out drain port 24. As a result of the pressure differential between second chamber 74 and first chamber 72, piston 66 of actuator means 60 will be displaced to the right. This rightward displacement of piston 66 and arm 82 will actuate the rack of the engine fuel injection pump causing it to meter less fuel to the engine and result in decreased operating RPM of the engine.

This rightward displacement of arm 82 will also displace the wiper of potentiometer 84, altering the voltage signal transmitted on conductor 86 to control means 36. In response to the movement of arm 82 and the perceived difference in operating RPM as the result of the signal transmitted by magnetic pickup 88, control means 36 will transmit a control signal to fuel injector 28 to open port 92 and thus meter additional fluid into control chamber 26. The metering of additional fluid into control chamber 26 will increase the pressure in that chamber to a level in excess of the biasing force from spring 38 resulting in a rightward displacement of piston 16. When the engine RPM has been decreased so that it equals the desired operating RPM, piston 16 will have returned to its neutral or equilibrium position terminating all flow into or out of chambers 72 and 74.

As the engine operating RPM decreases to a level below the desired operating RPM, a sequence of events exactly opposite to that discussed immediately above will occur, resulting in a rightward displacement of piston 16 from its neutral or equilibrium position and the resultant leftward movement of piston 66 of actuator 60. During rightward displacements of piston 16, hydraulic fluid discharged from chamber 74 will flow into second sliding chamber 50 and be discharged through drain port 25.

Figure 2:
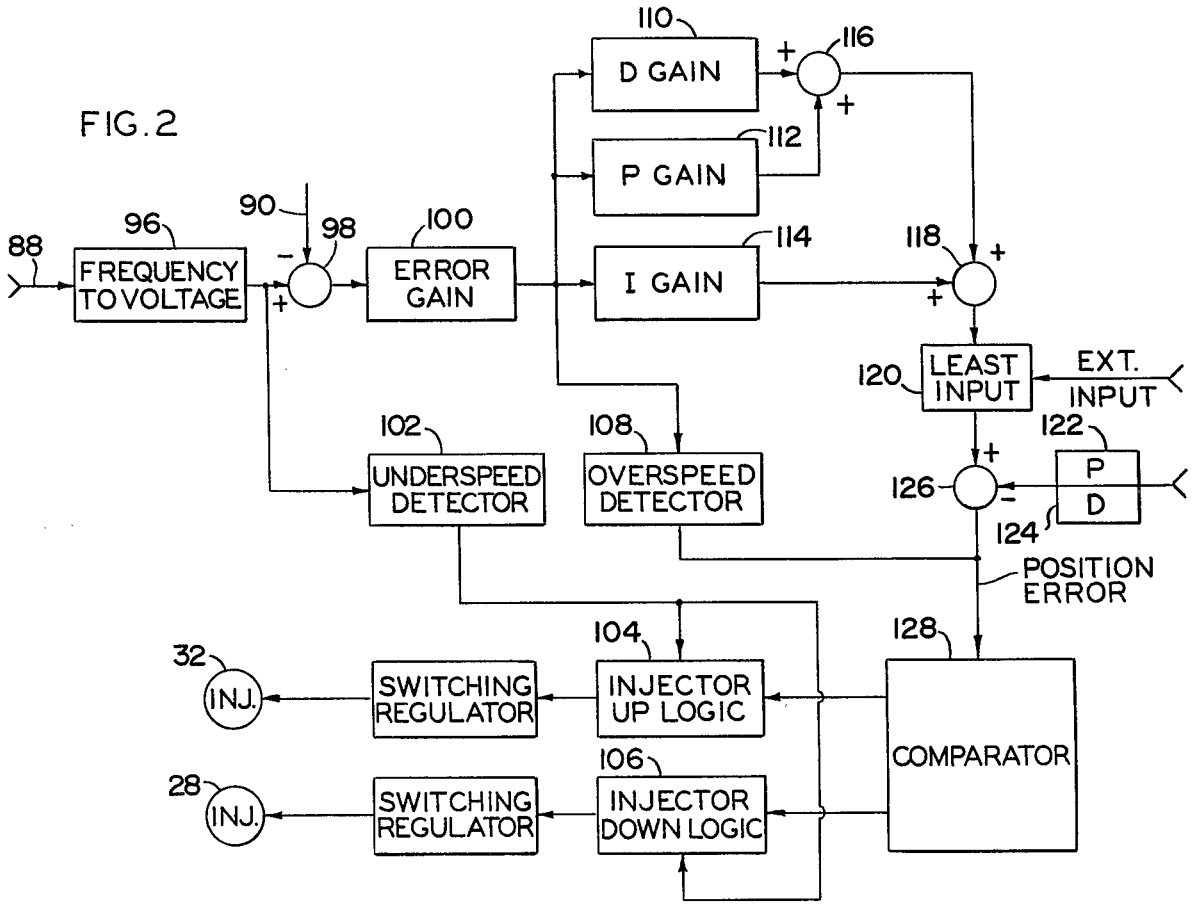
FIG. 2 is a block diagram of the electronic elements of control means 36 illustrated in FIG. 1.

Referring now to FIG. 2, the structure and operation of control means 36 will be described. Frequency to voltage converter 96 receives the alternating current electrical signal from magnetic pickup 88 and converts this signal to a D.C. voltage which is coupled to summer 98. The electrical signal from speed adjustment potentiometer 90 is coupled to the second input of summer 98. Summer 98 generates an error output signal representative of the difference in RPM between the operating RPM and the desired RPM. This error signal is coupled to the input of an error gain amplifier 100 which amplifies the error signal.

The output of frequency to voltage converter 96 is also coupled to underspeed detector 102 which generates an output signal whenever the output voltage from frequency to voltage converter 96 indicates that the RPM of the engine is less than the cranking RPM or the magnetic pickup 88 is inoperative. Underspeed detector 102 is provided for installations where control means 36 is maintained in an energized state at all times and functions to generate an output signal which disconnects the power from injectors 28 and 32. Underspeed detector 102 accomplishes de-energization by transmitting a "turn off" signal to the injector uplock logic 104 and injector downlock logic 106 circuits. Thus, during a standby period when power is connected to control means 36, the approximate 300 milliampere current drawn by injectors 28 and 32 will be terminated.

Overspeed detector 108 is coupled to the output of error gain amplifier 100 in order to detect an overspeed condition of the engine. If an error signal sufficient to actuate overspeed detector 108 actually exists, it is indicative of a system malfunction. Overspeed detector 108 then generates an output signal which causes the piston of actuator means 60 to be fully deflected to the right to shut down the fuel injector pump of the engine. Overspeed detector 108 latches in the off position in order to prevent resumption of normal engine operation following a system malfunction.

The output of error gain amplifier 100 is also coupled to the input of derivative gain amplifier 110, proportional gain amplifier 112 and integral gain amplifier 114. Derivative gain amplifier 110 takes the derivative of the error signal and amplifies it by a predetermined amount. For a steady state error signal the output of amplifier 110 will be zero, while for an increasing error signal the output will be positive. A decreasing error signal will result in a negative output from amplifier 110.

Proportional gain amplifier 112 is used to amplify the output from amplifier 100 by a predetermined adjustable amount. The output signals from amplifiers 110 and 112 are coupled to summer 116.

Amplifier 114 integrates the error signal from amplifier 100 to permit detection of very small speed errors. The output of amplifier 114 and summer 116 are coupled to the inputs of summer 118.

The output of summer 118 is coupled to the input of least input detector 120. Least input detector 120 also receives an external input which permits the incorporation of an additional input signal for controlling the engine operating speed. This external input signal permits an operator to intentionally reposition the rack to a predetermined position as might be required during an emergency to allow an operator to shut the engine down or to permit the engine to operate at a predetermined idle RPM for a set amount of time in order to warm the engine up to normal operating temperatures. Least input detector 120 accepts the lowest magnitude input signal from either summer 118 or the external input. The two inputs to detector 120 are received in the form of a rack position input instead of an error signal of the type generated by amplifier 100.

The rack position signal from potentiometer 84 is coupled by conductor 86 to proportional amplifier 122 and derivative amplifier 124. Proportional gain amplifier 122 is provided to amplify the electrical signal from potentiometer 84. Amplifier 124 is provided to further increase the magnitude of the output signal from potentiometer 84 when rapid changes in the position of arm 82 occur. The output of these two amplifiers is coupled to the input of summer 126 which also receives the output of least input detector 120. The output of summer 126 is in the form of a position error signal which is coupled to the input of comparator 128. When comparator 128 detects an input signal representative of an engine underspeed condition, it transmits a signal to injector down logic 106 which actuates the switching regulator for injector 28 which repositions piston 16 and piston 66 to regulate the position of the engine fuel injection pump. Conversely, an overspeed condition actuates injector up logic 104 and the switching regulator for injector 32 which accomplishes the desired effect.

Specific electrical schematic diagrams for the various elements of control means 36 have not been disclosed since they are well known to those skilled in the art and could readily be fabricated on the basis of the disclosure in FIG. 2 taken together with the above description.

Figure 3:
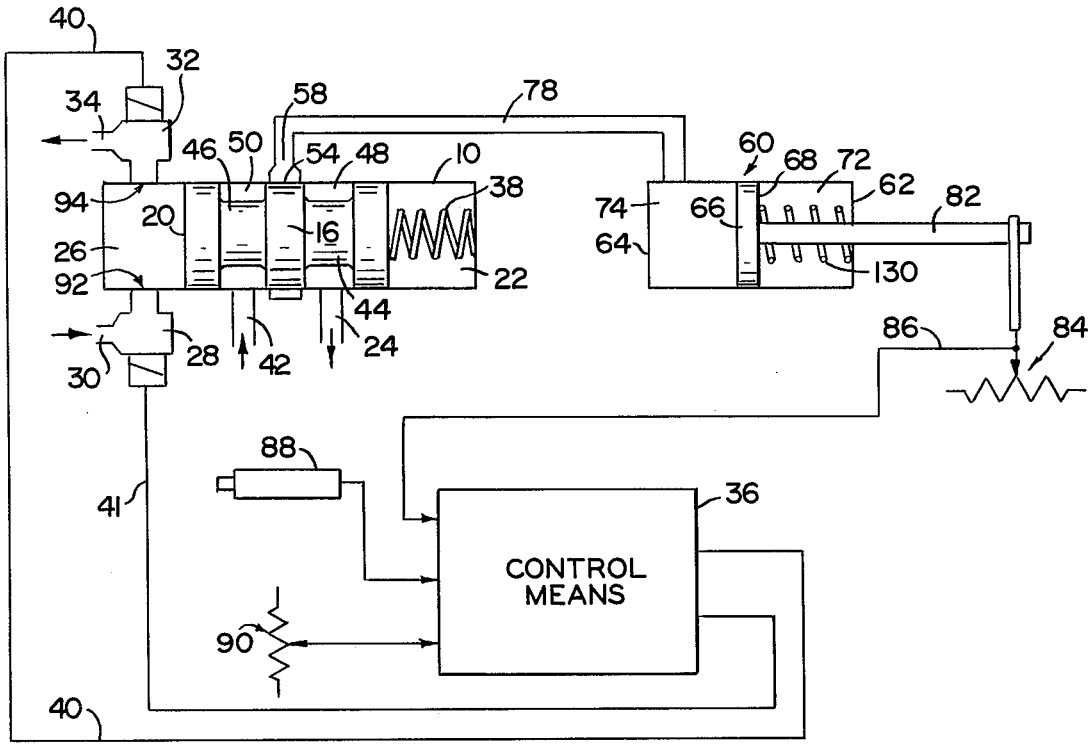
FIG. 3 is a sectional view of a second embodiment of the mechanical structure of the governor of the present invention illustrated in FIG. 1.

Referring now to FIG. 3, a somewhat different configuration of the mechanical elements of the governor of the present invention is illustrated. In this embodiment, inlet port 42 communicates with second sliding chamber 50, while drain port 24 communicates with first sliding chamber 48. Piston 16 includes only second valve surface 54 and a single second port 58. Second passageway 78 serves to transmit hydraulic fluid back and forth between first and second sliding chambers 48 and 50 and second chamber 74 of actuator means 60.

First chamber 72 of actuator means 60 is vented to atmosphere and a biasing means or spring 130 is coupled to first face 68 of piston 66 and to first end 62 of the cylinder of actuator means 60. Unpressurized chamber 22 of main chamber 10 is maintained at an essentially ambient pressure level and never receives hydraulic fluid.

In addition to serving as a governor for a diesel engine, the apparatus illustrated in FIG. 1 and FIG. 3 can also be used as an electrically controlled, hydraulically actuated control system for precisely positioning the piston of a hydraulic actuator means 60 in response to a position input signal. In this embodiment, the input from element 90 would generate a position signal instead of a speed signal which would be coupled to the input of control means 36. Potentiometer 84 would still serve as a position feedback sensor for generating an electrical feedback signal to control means 36.

It would be apparent to those skilled in the art that the disclosed governor may be modified in numerous ways and may assume many embodiments other than the preferred forms typically set out and described above. Accordingly, it is intended by the appended claims to cover all such modifications of the invention which fall into the true spirit and scope of the invention.

We claim:

1. An electronically controlled, hydraulically actuated precision governor for controlling the operating RPM of a diesel engine by repositioning the rack of the engine fuel injection pump in response to changes in engine RPM, said governor comprising:

(a) a main chamber having first and second end surfaces;

(b) a piston slideably positionable about a neutral location within said main chamber and having first and second faces;

(c) biasing means positioned between the first end surface of said chamber and the first face of said piston for biasing said piston toward the second end surface of said main chamber;

(d) an unpressurized chamber positioned within said main chamber between the first end surface thereof and the first face of said piston;

(e) a variable pressure control chamber positioned within said main chamber between the second end surface thereof and the second face of said piston;

(f) an equilibrium pressure within said control chamber which defines said neutral location of said piston;

(g) first electrically controllable valve means coupled to said control chamber and to a source of pressurized fluid for metering fuel into or out of said control chamber to regulate the pressure in said control chamber above or below said equilibrium pressure in response to a control signal to controllably displace said piston toward either the first or second end surfaces of said main chamber;

(h) an inlet port positioned in said main chamber between the first and second faces of said piston and coupled to the source of pressurized fluid;

(i) actuator means hydraulically coupled to said main chamber between the first and second faces of said piston for displacing the rack of the fuel injection pump in response to fluid presssure from said main chamber;

(j) second valve means coupling said main chamber to said actuator means when said piston is not in said neutral location and conducting pressurized fluid from said inlet port to said actuator means to displace said actuator means in a first direction when said piston is displaced toward the first end surface of said main chamber and for displacing said actuator means in a second direction when said piston is displaced toward the second end surface of said main chamber; and (k) control means coupled to the rack of the fuel injection pump and to said first valve means, including (i) RPM sensor means for measuring the operating RPM of the engine and (ii) RPM command means for designating a selected engine operating RPM for generating the control signals which actuate said first valve means to displace said piston to reposition the rack of the fuel injection pump to maintain the selected engine operating RPM.

2. The governor of claim 1 wherein said first valve means include pressure reducing valve means for reducing the pressure in said control chamber in response to the control signal and thereby permitting said biasing means to displace said piston toward the second end surface of said main chamber.

3. The governor of claim 2 wherein said first valve means includes pressure increasing valve means for increasing the pressure in said control chamber in response to the control signal and thereby displacing said piston toward the first end surface of said main chamber.

4. The governor of claim 1 wherein said control means further includes rack position feedback means for generating an electrical signal representative of the position of the rack.

5. The governor of claim 1 wherein said actuator means includes:

(a) an actuator cylinder having first and second ends; and (b) an actuator piston having first and second faces positioned midway in the cylinder of said actuator.

6. The governor of claim 1 wherein said biasing means includes a spring.

7. The governor of claim 3 wherein said pressure reducing valve means and said pressure increasing valve means include solenoid operated valves.

8. The governor of claim 5 wherein said actuator means further includes:

(a) a first chamber positioned between the first end of said actuator cylinder and the first face of said actuator piston; and (b) a second chamber positioned between the second end of said actuator cylinder and the second face of said actuator piston.

9. The governor of claim 1 wherein the outer wall of said piston includes first, second and third indentations.

10. The governor of claim 9 wherein said first, second and third indentations in the outer wall of said piston form first, second and third sliding chambers between the wall of said piston and the wall of said main chamber.

11. The governor of claim 10 wherein said second valve means includes:

(a) a first valve surface on the outer wall of said piston between said third indentation and said first indentation; and (b) a second valve surface on the outer wall of said piston between said first indentation and said second indentation.

12. The governor of claim 11 wherein said second valve means further includes:

(a) a first port in the wall of said main chamber adjacent said first valve surface; and (b) a second port in the wall of said main chamber adjacent said second valve surface.

13. The governor of claim 12 wherein said second valve means includes:

(a) a first passageway for establishing fluid communication between said first port and said first chamber of said actuator means; and (b) a second passageway for establishing fluid communication between said second port and said second chamber of said actuator means.

14. The governor of claim 13 wherein displacement of said piston in the first direction from the neutral position causes pressurized fluid to flow from said inlet port through said first sliding chamber, said first port, and said first passageway into said first chamber of said actuator means while simultaneously discharging fluid from said second chamber of said actuator means through said second passageway, said second port, and said second sliding chamber.

15. The governor of claim 13 wherein displacement of said piston in the second direction causes pressurized fluid to flow from said inlet port through said first sliding chamber, said second port, and said second passageway into said second chamber of said actuator means while simultaneously discharaging fluid from said first chamber of said actuator means through said first passageway, said first port, and said third sliding chamber.

16. The governor of claim 12 wherein said first and second valve surfaces prevent fluid flow through said first and second ports in said main chamber when said piston is in the neutral position.

17. The governor of claim 4 wherein said rack position feedback means includes a potentiometer coupled to said actuator means for converting a change in the position of said actuator piston into a change in electrical resistance.

18. The governor of claim 1 wherein said RPM sensor means includes magnetic pickup means coupled to a rotating element of the engine for measuring the operating RPM of the engine.

19. The governor claim 1 wherein said RPM command means includes a throttle.

20. An electrically controlled, hydraulic actuated control system for precisely positioning an actuator piston of a hydraulic actuator in response to a position input signal, said system comprising:

(a) a main chamber having first and second end surfaces;

(b) a piston slideably positionable about a neutral location within said main chamber and having first and second faces;

(c) biasing means positioned between the first end surface of said chamber and the first face of said piston for biasing said piston toward the second end surface of said main chamber;

(d) an unpressurized chamber positioned within said main chamber between the first end surface thereof and the first face of said piston;

(e) a variable pressure control chamber positioned within said main chamber between the second end surface thereof and the second face of said position;

(f) an equilibrium pressure within said control chamber which defines said neutral location of said piston;

(g) first electrically controllable valve means coupled to said control chamber and to a source of pressurized fluid for metering fuel into or out of said control chamber to regulate the pressure in said control chamber above or below said equilibrium pressure in response to a control signal to controllably displace said piston toward either the first or second end surfaces of said main chamber;

(h) an inlet port positioned in said main chamber between the first and second faces of said piston and coupled to the source of pressurized fluid;

(i) second valve means coupling said actuator to said main chamber when said piston is not in said neutral location and conducting pressurized fluid from said inlet port to said actuator to displace said actuator piston in a first direction when said piston is displaced toward the first end surface of said main chamber and displacing said actuator piston in a second direction when said piston is displaced toward the second end surface of said main chamber;

(j) actuator position feedback means coupled to said actuator for generating a singal representative of the position of said actuator piston; and (k) control means coupled to said actuator position feedback means and to said first valve means for generating the control signal which actuates said first valve means to displace said piston to reposition said actuator piston in response to the position input signal.

21. The system of claim 20 wherein said first valve means includes pressure reducing valve means for reducing the pressure in said control chamber in response to the control signal and thereby permitting said biasing means to displace said piston toward the second end surface of said main chamber.

22. The system of claim 21 wherein said first valve means includes pressure increasing valve means for increasing the pressure in said control chamber in response to the control signal and thereby displacing said piston toward the first end surface of said main chamber.

23. The system of claim 20 wherein said actuator position feedback means includes means for generating an electrical signal representative of the position of said actuator piston.

24. The system of claim 20 wherein said actuator includes:

(a) a cylinder having first and second ends; and (b) said actuator piston includes first and second faces.

25. The system of claim 20 wherein said biasing means includes a spring.

26. The system of claim 22 wherein said pressure reducing valve means and said pressure increasing valve means include solenoid actuated valves.

27. The system of claim 24 wherein said actuator further includes:

(a) a first chamber positioned between the first end of said cylinder and the first face of said actuator piston; and (b) a second chamber positioned between the second end of said cylinder and the second face of said actuator piston.

28. The system of claim 20 wherein the outer wall of said piston includes first, second and third indentations.

29. The system of claim 28 wherein said first, second and third indentations in the outer wall of said piston form first, second and third sliding chambers between the wall of said piston and the wall of said main chamber.

* * * * *